US011066269B2

(12) United States Patent
Takahashi

(10) Patent No.: US 11,066,269 B2
(45) Date of Patent: Jul. 20, 2021

(54) SHEET FOLDING PROCESSING APPARATUS AND IMAGE FORMING SYSTEM INCLUDING THE SAME

(71) Applicant: Katsuya Takahashi, Yamanashi-ken (JP)

(72) Inventor: Katsuya Takahashi, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 0 days.

(21) Appl. No.: 16/843,227

(22) Filed: Apr. 8, 2020

(65) Prior Publication Data

US 2020/0324995 A1 Oct. 15, 2020

(30) Foreign Application Priority Data

Apr. 11, 2019 (JP) ..... JP2019-075416

(51) Int. Cl.

*B65H 45/20* (2006.01)
*B65H 45/14* (2006.01)
*B65H 45/04* (2006.01)

(52) U.S. Cl.

CPC ..... *B65H 45/14* (2013.01); *B65H 45/04* (2013.01); *B65H 45/20* (2013.01); *B65H 2801/06* (2013.01)

(58) Field of Classification Search

None

See application file for complete search history.

(56) References Cited

U.S. PATENT DOCUMENTS 8,317,181 B2 * 11/2012 Suzuki ..... B65H 45/18 270/45

FOREIGN PATENT DOCUMENTS

JP 05319686 A * 12/1993
JP 2002-068583 A 3/2002
JP 2011-246221 A 12/2011

OTHER PUBLICATIONS

Espacenet machine translation of JP05319686A; http://translationportal.epo.org/emtp/translate/?ACTION=description-retrieval&COUNTRY=JP&ENGINE=google&FORMAT=docdb&KIND=A&LOCALE=enEP&NUMBER=H05319686&OPS=ops.epo.org/3.2&SRCLANG=ja&TRGLANG=en (Year: 1993).*

* cited by examiner

*Primary Examiner* — Leslie A Nicholson, III
(74) *Attorney, Agent, or Firm* — Manabu Kanesaka

(57) ABSTRACT

A sheet folding processing apparatus suppresses an increase in size and cost of the apparatus and performs folding processing on continuously conveyed sheets. In the sheet folding processing apparatus, a sheet conveyed by a feeding roller pair and hang in a loop shape in a loop forming space is pushed into a nipping portion of a folding roller pair by a pushing plate, so that the sheet is folded in a Z-shape to form a plurality of fold lines. The sheet is conveyed in the conveyance direction until the sheet rear end passes through the feeding roller pair, and after the sheet rear end is stored in a loop forming space by moving the pushing plate from a position for pushing the sheet into a nipping portion to a retracting position, the reinforcing processing of the fold line of the sheet is performed by an additional folding unit.

8 Claims, 11 Drawing Sheets

SHEET FOLDING PROCESSING APPARATUS AND IMAGE FORMING SYSTEM INCLUDING THE SAME

CROSS-REFERENCE TO RELATED APPLICATION

The present application is based on and claims priority of Japanese Patent Application No. 2019-075416 filed on Apr. 11, 2019, the disclosure of which is incorporated herein.

TECHNICAL FIELD

The present invention relates to a sheet folding processing apparatus which performs folding processing on a sheet, and an image forming system including the sheet folding processing apparatus such as a copier, a printer, a facsimile, and a compound machine of the above.

BACKGROUND ART

Conventionally, a sheet folding processing apparatus (a post processing apparatus) which is installed in an image forming system such as a copier and a printer and performs folding processing on an image formed sheet has been widely known. The folding processing includes double folding in which a sheet is folded at a center position, triple folding in which a sheet is folded inward at two positions, and so-called Z folding in which a sheet is alternately folded inward and outward to be folded in three.

For example, Japanese Patent Application Laid-Open No. 2002-68583 discloses a paper piece folding apparatus in which a pair of feed rollers is provided on an upstream side of a horizontal upper guide plate, a pair of paper folding rollers is provided on a downstream side thereof, and a paper piece guiding-deflecting member (i.e., a pushing member) is provided on an upstream side of the pair of paper folding rollers. In this apparatus, the paper piece guiding-deflecting member is moved from a second position retracted obliquely downward on the upstream side of the pair of paper folding rollers to a first position in which the front end thereof is brought close to a paper piece inlet of the pair of paper folding rollers, and a predetermined position of the paper piece hanging in the space in front of the pair of paper folding rollers is drawn into the paper piece inlet to fold the paper piece as double folding or Z folding.

For example, Japanese Patent Application Laid-Open No. 2011-246221 discloses a crease forming apparatus including a main path MP in which a crease forming member 6 for additional folding processing is arranged, a switchback path SB branched from the main path MP in a direction opposite to a sheet conveyance direction, and a branching unit t1 for guiding a sheet from the main path MP to the switchback path SB. In the crease forming apparatus, when a sheet is conveyed to the crease forming member 6, the preceding sheet Sn is conveyed in an opposite direction to convey a rear end of the preceding sheet Sn from the branching unit t1 to the switchback path SB after the rear end of the preceding sheet Sn exceeds the branching unit t1. Then, conveyance of the sheet is stopped so that the crease forming position of the preceding sheet Sn corresponds to the position of the crease forming member 6, and the preceding sheet Sn is discharged from the position of the crease forming member 6 before a subsequent sheet Sn+1 conveyed while the preceding sheet Sn is conveyed in the reverse direction or while the preceding sheet Sn is creased reaches the crease forming member 6.

SUMMARY OF THE INVENTION

When folding processing is performed on an image formed sheet in this manner, since certain time is required for the folding processing, a problem occurs that a subsequent sheet catches up with the sheet on which the folding processing is performed. In particular, since processing time is long for performing Z-folding (triple folding) on a relatively long sheet as disclosed in Japanese Patent Application Laid-Open No. 2002-68583 described above, such a problem is likely to occur.

The crease forming apparatus disclosed in Japanese Patent Application Laid-Open No. 2011-246221 is a crease forming device for forming a folding trace or performing creasing on a sheet before double folding the sheet. Here, it is the same as in the case of performing folding processing that certain time is required for forming a folding trace. In the crease forming device disclosed in Japanese Patent Application Laid-Open No. 2011-246221, a switchback path is provided upstream of a creasing member for forming a folding trace, and a timing at which a subsequent sheet is introduced into the creasing member is adjusted through temporarily storing the subsequent sheet in the switchback path, thereby preventing the above-described problem.

However, when the switchback path is provided in parallel with a conveyance path in the horizontal direction, there are disadvantages that a switching unit for switching the paths is required and that the size of sheets that can be stored is limited according to the length secured as the switchback path. In addition, since creasing processing and introduction of a subsequent sheet into the switchback path are performed in parallel, complicated control is required.

The present invention has been made to solve the problems existing in the above-described related art. The object thereof is to provide a sheet folding processing apparatus capable of accurately performing a series of additional folding processing in which a fold line is formed and additional folding to reinforce the formed fold line on continuously conveyed sheets is performed without lowering productivity and without increasing processing time while suppressing an increase in size and cost of the apparatus.

In view of the above-described object, a sheet folding processing apparatus of the present invention includes a conveyance unit which conveys a sheet in a conveyance direction, a folding unit including a nipping portion which performs folding processing to nip a predetermined part of the sheet conveyed by the conveyance unit and to form a fold line at the predetermined part, a loop forming space for forming a loop on the sheet between the conveyance unit and the folding unit, a pushing plate which contacts to the loop formed in the loop forming space and is movable between a guide position for guiding the predetermined part to the nipping portion of the folding unit and a retracting position closer to the conveyance unit than the guide position, and an additional folding unit which performs fold line reinforcing processing to reinforce the fold line formed by the folding unit, wherein the conveyance unit conveys the sheet in the conveyance direction after the folding processing is performed on the sheet by the folding unit, and the additional folding unit performs the fold line reinforcing processing on the fold line after a rear end of the sheet in the conveyance direction passes through the conveyance unit.

At this time, the rear end of the sheet in the conveyance direction is retracted into the loop forming space while the fold line reinforcing processing is performed on the fold line at the additional folding unit.

In one embodiment, a timing at which the pushing plate starts to move toward the retracting position when length of the sheet in the conveyance direction after the folding processing is performed on the sheet by the folding unit is longer than a predetermined length is delayed as compared to that when length of the sheet in the conveyance direction after the folding processing is performed on the sheet by the folding unit is shorter than the predetermined length, thereby forming the fold line accurately regardless of the sheet length.

Further, the retracting position of the pushing plate is preferably set closer to the conveyance unit when length of the sheet in the conveyance direction after the folding processing is performed on the sheet by the folding unit is longer than a predetermined length then that when length of the sheet in the conveyance direction after the folding processing is performed on the sheet by the folding unit is shorter than the predetermined length.

In another embodiment, a moving speed of the pushing plate toward the retracting position is set slower when length of the sheet in the conveyance direction after the folding processing is performed on the sheet by the folding unit is longer than a predetermined length then that when length of the sheet in the conveyance direction after the folding processing is performed on the sheet by the folding unit is shorter than the predetermined length, thereby interference between the sheet retracted into the loop forming space and the pushing plate can be prevented even in a case of a long sheet.

Further in another embodiment, in a case that the retracting position of the pushing plate is at a position where the rear end of the sheet in the conveyance direction is incapable of being retracted into the loop forming space even when the rear end of the sheet in the conveyance direction passes through the conveyance unit, the folding processing is performed on the sheet by the folding unit and the rear end of the sheet in the conveyance direction is retracted into the loop forming space through switchback at a time when the sheet is conveyed by a specific distance.

In this case, in a case that the folding processing is performed on the sheet by the folding unit and the rear end of the sheet in the conveyance direction is retracted into the loop forming space through the switchback at a time when the sheet is conveyed by the specific distance, the specific distance is set so that a front end of the sheet in the conveyance direction does not cause an influence on operation of a downstream apparatus.

According to the present invention, when performing a series of folding processing of fold line forming and additional folding, since a sheet rear end is retracted, at the time of additional folding, into a loop forming space used for loop forming at the time of fold line forming, it is possible to receive a subsequent sheet into the sheet folding processing apparatus even during additional folding, and productivity is not lowered even when folding processing is included. Moreover, by using the loop forming space, a buffer path such as a switchback path or a bypass path is not required, and accurate folding processing can be realized while suppressing an increase in size and cost of the apparatus.

EMBODIMENTS OF THE INVENTION

In the following, preferred embodiments of the present invention will be described with reference to the attached drawings.

First, an overall configuration of an image forming system including a sheet folding processing apparatus according to the present invention will be described with reference to FIG. 1. The image forming system is configured to include an image forming apparatus A, a sheet folding processing apparatus B, and a post processing apparatus C. After performing folding processing at the sheet folding processing apparatus B on a sheet on which an image has been formed at the image forming apparatus A, the sheet is subjected to stapling processing, alignment processing, and the like at the post processing apparatus C on the downstream side as necessary, and is discharged to a storage tray 27 on the downstream side. The image forming system may have various mechanisms such as a copier, a printer, and a printing machine. In the following, the image forming apparatus A, the sheet folding processing apparatus B, and the post processing apparatus C will be described in detail.

[Image Forming Apparatus]

Figure 1:
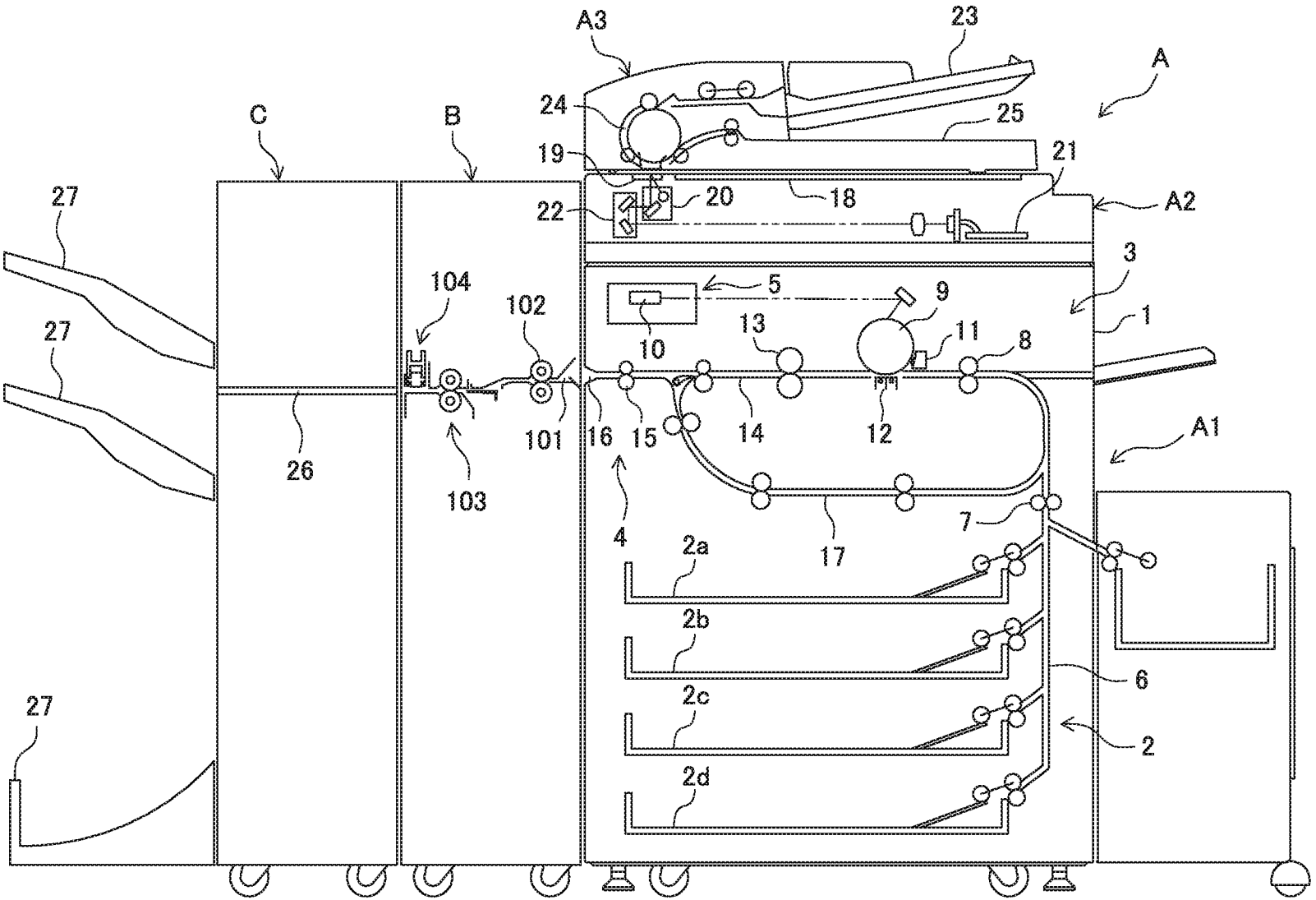
FIG. 1 is an overall configuration diagram of an image forming system including a sheet folding processing apparatus according to the present invention.

As illustrated in FIG. 1, the image forming apparatus A includes an image forming unit A1, a document reading unit A2, and a document feeding unit A3. The image forming unit A1 includes a sheet feeding section 2, an image forming section 3, a sheet discharging section 4, and a data processing section 5 in an apparatus housing 1.

The sheet feeding section 2 includes a plurality of cassettes 2*a*, 2*b*, 2*c*, and 2*d*, and each of the cassettes 2*a*, 2*b*, 2*c*, and 2*d* can store sheets of different standard sizes selected in advance. Each of the cassettes 2*a*, 2*b*, 2*c*, and 2*d* includes a separation mechanism for separating sheets therein one by one and a sheet feeding mechanism for feeding a sheet. Sheets stored in the sheet feeding section 2 having such a configuration are fed to the sheet feeding path 6 in a size designated by a main body controller (not illustrated). The sheet feeding path 6 is provided with a feeding roller 7 arranged at an intermediate part thereof for conveying sheets fed from the plurality of cassettes 2*a*, 2*b*, 2*c*, and 2*d* to the downstream side, and a registration roller 8 arranged at an end part of the sheet feeding path 6 for aligning the front end of the sheets. The sheets having the front end aligned by the registration roller 8 are fed to the image forming section 3 on the downstream side at a predetermined timing.

The image forming section 3 may be configured to form an image on a sheet fed from the sheet feeding section 2, and various image forming mechanisms can be adopted. In the illustrated embodiment, an electrostatic image forming mechanism is shown as the image forming section 3. However, the image forming section 3 is not limited to the illustrated electrostatic image forming mechanism, and an ink jet image forming mechanism, an offset image forming mechanism, or the like may be adopted as well.

In the image forming section 3 illustrated in FIG. 1, a photoreceptor 9 (a drum and a belt) and a light emitter 10 for emitting an optical beam to the photoreceptor 9 are provided, and a developing device 11 (developer) and a cleaner (not illustrated) are arranged around the photoreceptor 9 which rotates. A monochrome printing mechanism is shown, in which a latent image is optically formed on the photoreceptor 9 by the light emitter 10, and toner ink is adhered to the latent image by the developing device 11. The ink image (ink toner) adhered to the photoreceptor 9 is image-transferred by a transfer charger 12 onto a sheet fed from the sheet feeding section 2, fixing is performed on the image-transferred sheet by a fixing roller 13, and then, the sheet is fed to the sheet discharging path 14. Further, a circulation path 17 is provided in the image forming section 3. After the sheet from the sheet discharging path 14 is turned upside down in a switchback path, the sheet is fed to the registration roller 8 again, an image is formed on a back surface of the sheet, and the sheet is sent to the sheet discharging path 14. In the sheet discharging path 14, a sheet discharging roller 15 is arranged and a sheet discharging port 16 is formed at the end thereof. The sheet is conveyed from the sheet discharging port 16 to the sheet folding processing apparatus B by the sheet discharging roller 15.

The document reading unit A2 that optically reads a document image formed at the image forming section 3 is provided above the image forming unit A1 configured as described above, and a document feeding unit A3 is mounted above the document reading unit A2.

The document reading unit A2 includes a first platen 18 and a second platen 19 formed of transparent glass, a reading carriage 20, a light source mounted on the reading carriage 20, a photoelectric conversion element 21, and a reduction optical system 22 configured by combining a mirror and a lens. The reading carriage 20 scans along the first platen 18 so that light from the light source is illuminated on an image of a document sheet placed on the first platen 18, reflected light from the image of the document sheet is guided to the photoelectric conversion element 21 at the reduction optical system 22, and thus the image is read. The photoelectric conversion element 21 converts image data into an electric signal and transfers the electric signal to the image forming section 3.

The document feeding unit A3 includes a sheet feeding tray 23, a sheet feeding path 24, and a sheet discharging tray 25, and conveys documents placed on the sheet feeding tray 23 one by one along the sheet feeding path 24, passes the sheet over the second platen 19, and discharges the sheet to the sheet discharging tray 25. When reading a document fed from the document feeding unit A3 and passing over the second platen 19, the reading carriage 20 is stopped in advance below the second platen 19, and image data is generated from an image passing over the second platen 19.

[Post Processing Apparatus]

The post processing apparatus C is connected to a further downstream side of the sheet folding processing apparatus B connected to the image forming apparatus A, receives a sheet that has been subjected to folding processing at the sheet folding processing apparatus B or that has not been subjected to folding processing, and performs stapling processing, aligning processing, and the like as necessary.

A post processing path 26 is provided in the post processing apparatus C, and post processing devices (not illustrated) such as a stapling unit and an aligning unit are arranged along the post processing path 26. The post processing apparatus C receives a sheet discharged from the image forming apparatus A via the sheet folding processing apparatus B, performs stapling processing, aligning processing, and the like on the received sheet with a post processing device such as a stapling unit and an aligning unit as necessary, and then discharges and stores the sheet in the storage tray 27.

[Sheet Folding Processing Apparatus]

The sheet folding processing apparatus B connected to the image forming apparatus A is an apparatus that receives an image formed sheet discharged from the sheet discharge port 16 of the image forming apparatus A and performs folding processing.

Figure 2:
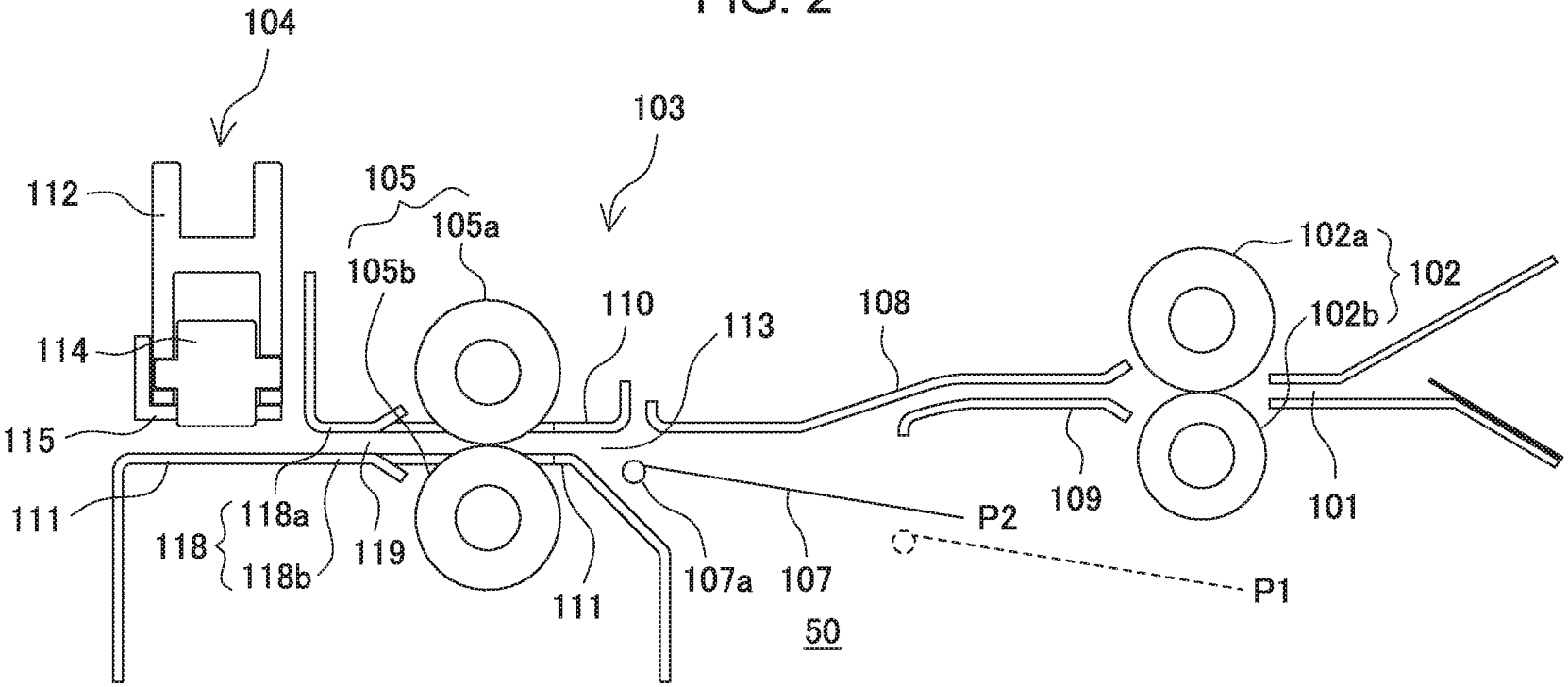
FIG. 2 is an explanatory view of a main portion of a folding processing mechanism and an additional folding unit of the folding processing apparatus illustrated in FIG. 1.

FIG. 2 illustrates an internal configuration of the sheet folding processing apparatus B. A conveyance path 101 extending in a substantially horizontal direction is provided in the sheet folding processing apparatus B. The conveyance path 101 is provided with one or a plurality of feeding roller pairs 102 and a folding processing mechanism 103, that is, a folding unit arranged on a downstream side of the feeding roller pair 102, and an additional folding unit 104 for strengthening a fold line formed on a sheet with the folding processing mechanism 103 is further provided at an end part of the conveyance path 101 on a downstream side of the folding processing mechanism 103. The sheet folding processing apparatus B is configured to perform folding processing with the folding processing mechanism 103 on a sheet conveyed along the conveyance path 101, then perform additional folding processing with the additional folding unit 104, and deliver the sheet subjected to the folding processing and the additional folding processing to the post processing apparatus C.

As illustrated in FIG. 1, the conveyance path 101 is arranged so as to be continuous with the sheet discharging port 16 of the image forming apparatus A, and a sheet discharged from the sheet discharging port 16 can be conveyed into the sheet folding processing apparatus B via the conveyance path 101. The discharging port of the additional folding unit 104 is also arranged so as to be continuous with the post processing path 26 of the post processing apparatus C, and a sheet discharged from the additional folding unit 104 can be conveyed into the post processing apparatus C via the post processing path 26.

The feeding roller pair 102, which is a conveyance unit that conveys a sheet along the conveyance path 101 in a predetermined conveyance direction, is formed of a rubber roller, and includes an upper feeding roller 102*a* arranged on an upper side of the conveyance path 101 and a lower feeding roller 102*b* arranged on a lower side thereof to face the upper feeding roller 102*a*. In the present embodiment, the upper feeding roller 102*a* is coupled to a feeding roller driving motor (not illustrated), and is configured to rotate in accordance with rotation of the feeding roller driving motor, while the lower feeding roller 102*b* is in pressure contact to the upper feeding roller 102*a* due to an urging force of a spring (not illustrated), and is configured to rotate in a following manner. However, the feeding roller pair 102 is not limited to the above-described configuration as long as a sheet can be conveyed, and an appropriate configuration can be adopted.

The folding processing mechanism 103 is configured of a folding roller pair 105 and a pushing plate 107. The folding roller pair 105 is formed of a rubber roller, and includes an upper folding roller 105*a* arranged on an upper side and a lower folding roller 105*b* arranged on a lower side to face the upper folding roller 105*a*. The lower folding roller 105*b* is in pressure contacted to the upper folding roller 105*a* due to an urging force of a spring (not illustrated). The upper folding roller 105*a* and the lower folding roller 105*b* are coupled to a common folding roller driving motor (not illustrated) and rotate in opposite directions to each other in accordance with rotation of the folding roller driving motor. An upper conveyance guide 108, a lower conveyance guide 109, an upper folding guide 110, and a lower folding guide 111 are provided at the conveyance path 101 between the feeding roller pair 102 and the folding roller pair 105.

The upper conveyance guide 108 is formed from a position right after the feeding roller pair 102 to a position above the pushing plate 107 so as to guide a front end of a sheet from the feeding roller pair 102 to the pushing plate 107. The upper conveyance guide 108 is for regulating the flow of a sheet conveyed through the conveyance path 101, is arranged on the upper side of the conveyance path 101, and has a shape bent downward toward the downstream side. The upper folding guide 110 is arranged between the upper conveyance guide 108 and the folding roller pair 105, and extends to a position right before the folding roller pair 105 so as to guide a front end of a sheet and a folded portion of the sheet described later to the folding roller pair 105. The upper folding guide 110 is for regulating the flow of a sheet in the folding processing mechanism 103, and is provided on the upper side of the conveyance path 101 at the downstream side of the upper conveyance guide 108.

The lower conveyance guide 109 is for regulating the flow of a sheet conveyed through the conveyance path 101, is arranged on the lower side of the conveyance path 101, and has a shape bent downward toward the downstream side similarly to the upper conveyance guide 108. The lower conveyance guide 109 is interrupted in front of the pushing plate 107, and an open loop forming space 50 is formed on the downstream side of the lower conveyance guide 109. The lower folding guide 111 is arranged on the downstream side of the pushing plate 107 and extends across the upstream side and the downstream side of the folding roller pair 105. A part of the lower folding guide 111 on the upstream side of the folding roller pair 105 has a horizontal surface for guiding a front end of a conveyed sheet and a folded portion of the sheet described later to a nipping portion of the folding roller pair 105 and an inclined surface for facilitating the above guiding to the horizontal surface.

The pushing plate 107 is positioned below the conveyance path 101, includes a sheet drawing guide roller 107*a*, and is arranged to be inclined with respect to the conveyance path 101 so that the front end thereof faces a sheet drawing port 113 of the folding roller pair 105. The pushing plate 107 is coupled to a pushing plate driving portion configured of a solenoid or a motor (not illustrated in FIG. 2), and moves, in accordance with the driving of the pushing plate driving portion, between a first position P1 which is a retracting position substantially directly below the feeding roller pair 102 or the lower conveyance guide 109 and a second position P2 which brings a sheet drawing guide roller 107*a* close to the sheet drawing port 113.

When the pushing plate 107 is at the second position P2, the pushing plate 107 closes the loop forming space 50 between the lower conveyance guide 109 and the lower folding guide 111, and a sheet conveyed into the conveyance path 101 is guided by the pushing plate 107 to the nipping portion of the folding roller pair 105. Then, when a front end of the conveyed sheet is nipped by the folding roller pair 105, in order to form the folded portion, the pushing plate 107 moves in the horizontal direction to the first position P1 which is a retracting position below the lower conveyance guide 109, and the loop forming space 50 between the lower conveyance guide 109 and the lower folding guide 111 is opened. Then, when the feeding roller pair 102 conveys the sheet by a predetermined amount in a state that the front end of the sheet is nipped by the folding roller pair 105, an intermediate portion of the sheet is sagged downward in the loop forming space 50 to form a loop portion. In this state, the pushing plate 107 is moved in the horizontal direction from the first position P1 which is the retracting position toward the folding roller pair 105 to form the folded portion, and after the pushing plate 107 reaches the second position P2 in front of the folding roller pair 105, the folding roller pair 105 is driven to convey the sheet, thereby forming a first fold line. Further, after the pushing plate 107 is moved to the first position P1 which is the retracting position, the sheet is conveyed by the folding roller pair 105 to nip the loop portion, thereby a second fold line is formed and the Z-folded sheet is conveyed to the downstream side.

Figure 3:
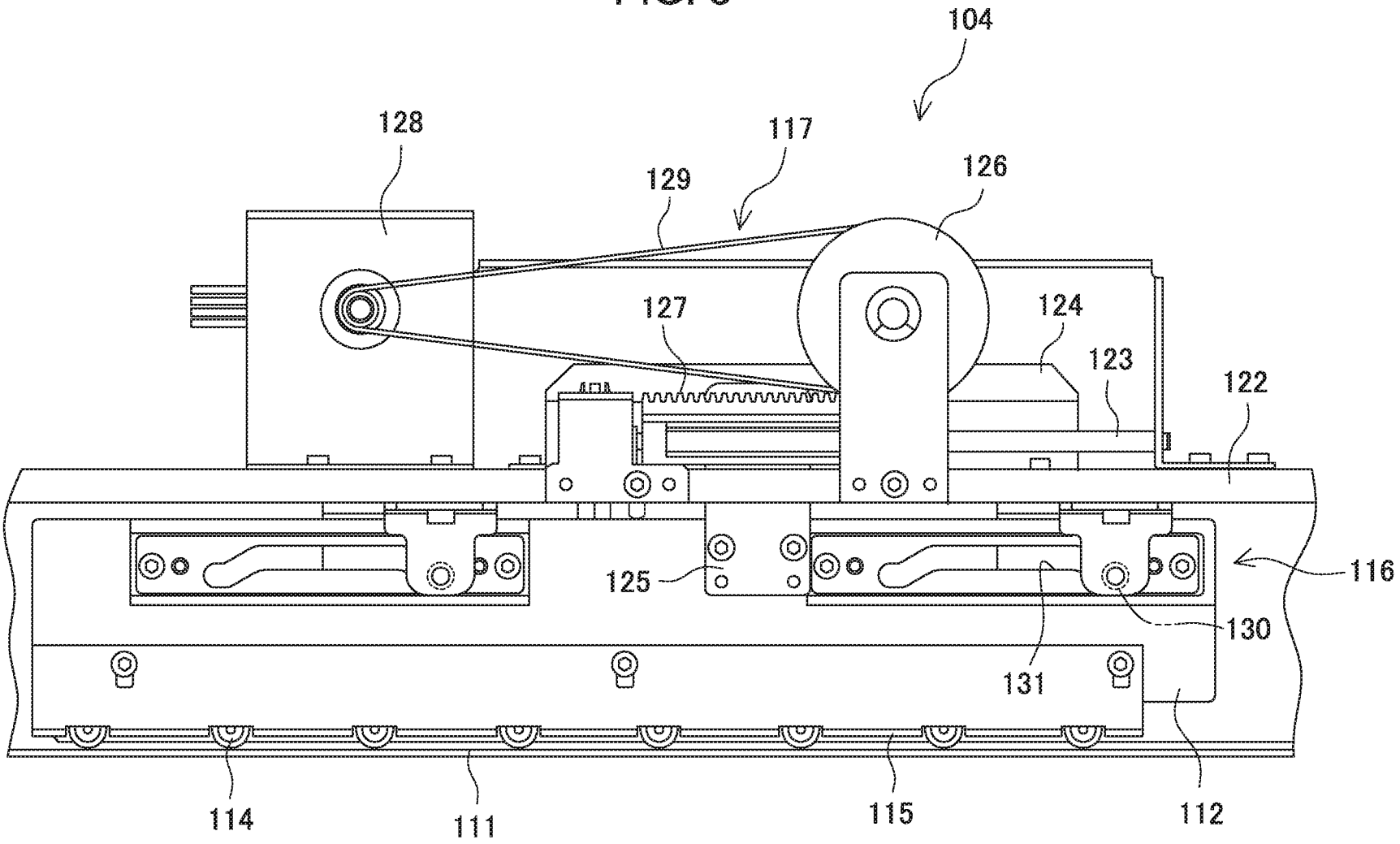
FIG. 3 is a view of the additional folding unit of the folding processing apparatus illustrated in FIG. 1 as viewed from a discharging port side.

Next, a configuration of the additional folding unit 104 will be described with reference to FIG. 3. The additional folding unit 104 is arranged above the lower folding guide 111 on the downstream side of the folding roller pair 105 in the sheet conveyance direction. The additional folding unit 104 includes a movable support member 112, a plurality of additional folding rollers 114 supported by the support member 112, a regulating member 115 attached to the support member 112, a first moving mechanism 116 that moves the support member 112 in a direction approaching and separating from the lower folding guide 111, and a second moving mechanism 117 that moves the support member 112 in the horizontal direction along a fold line of a sheet. Parts of the upper folding guide 110 and the lower folding guide 111, which are arranged to face each other in the vertical direction, on the downstream side of the folding roller pair 105 function as a carry-in guide pair 118 that guides a sheet into the additional folding unit 104. An upstream end part of the carry-in guide pair 118 forms a carry-in port 119 of the additional folding unit 104. An additional folding portion is configured of the plurality of additional folding rollers 114 supported by the support member 112 as described above and the lower folding guide 111.

The plurality of additional folding rollers 114 supported by the support member 112 are arranged in a row, spaced apart from each other at a predetermined interval, in the direction of the fold line of the sheet in a pressing member arrangement region so that each of the plurality of additional folding rollers is rotatable about a rotation axis line extending in the sheet conveyance direction (a direction parallel to the upper surface of the lower folding guide 111 and perpendicular to the fold line of the sheet). As described above, since each additional folding roller 114 is supported by the support member 112 such that the rotation axis line of each additional folding roller 114 extends in the sheet conveyance direction, width of each additional folding roller 114 is only required to be a size crossing the fold line in the sheet conveyance direction, and the width in the sheet conveyance direction can be narrowed regardless of the diameter of the additional folding rollers 114. Therefore, the plurality of additional folding rollers 114 can be arranged close to the folding roller pair 105, so that the sheet folding processing apparatus B can be downsized.

Further, the first moving mechanism 116 moves the support member 112 that supports the plurality of additional folding rollers 114 in a direction approaching and separating from the lower folding guide 111. Thus, the plurality of additional folding rollers 114 are moved approaching and separating from the lower folding guide 111, and the plurality of additional folding rollers 114 can be moved between a pressing position at which the fold line of the sheet positioned between each additional folding roller 114 and the lower folding guide 111 is pressed by each additional folding roller 114 and the lower folding guide 111 and a retracting position at which the plurality of additional folding rollers 114 are moved from the pressing position in a direction separating from the sheet. The second moving mechanism 117 moves the support member 112 in the horizontal direction (the right-left direction in FIG. 3) at the pressing position, thereby enabling the plurality of additional folding rollers 114 to move along the fold line of the sheet. Here, the plurality of additional folding rollers 114 and the lower folding guide 111 are in direct contact with each other if a sheet is not interposed therebetween at the pressing position. Length of the pressing member arrangement region (i.e., distance between the additional folding rollers 114 arranged at both end positions in the pressing member arrangement region) is determined such that one end portion of a fold line of a sheet (the end portion on the upstream side in the moving direction of the additional folding roller 114) is arranged between two additional folding rollers 114 arranged adjacent to one end position when moved from the retracting position to the pressing position and that the additional folding roller 114 arranged at the other end position is arranged above the fold line. Preferably, as in the illustrated embodiment, the length of the pressing member arrangement region, that is, the length between the additional folding rollers 114 arranged at both end positions of the pressing member arrangement region is set shorter than length of a fold line of a sheet conveyed into the additional folding unit 104 by one pitch of the arrangement of the plurality of additional folding rollers 114 (one interval between two additional folding rollers 114 arranged adjacent to each other). In this case, the number of the required additional folding rollers 114 can be reduced, and the cost of the additional folding rollers 114 can be reduced. In addition, since the number of the additional folding rollers 114 supported by the support member 112 is reduced, with respect to a case that same force is applied to the support member 112, pressing force per each additional folding roller 114 against a sheet is increased, and the additional folding effect is increased. Therefore, efficient additional folding can be performed with smaller force.

In the additional folding unit 104, after a sheet is received in the additional folding unit 104 in a state that the plurality of additional folding rollers 114 are arranged at the retracting position or a receiving position separated from the pressing position to the retracting position side with respect to the lower folding guide 111, the sheet position is detected by a sheet position detecting unit (not illustrated) provided on the upstream side of the folding roller pair 105 to stop the sheet when a fold line of the sheet reaches the pressing position below the additional folding rollers 114, and the plurality of additional folding rollers 114 are moved, by the first moving mechanism 116, to the pressing position with respect to the lower folding guide 111. The sheet is conveyed into the additional folding unit 104 such that, when the plurality of additional folding rollers 114 move to the pressing position, one end of the fold line (the upstream end in the direction of movement along the fold line) is arranged between the two additional folding rollers 114 at one end position in the pressing member arrangement region, and that the other end of the fold line (the downstream end in the direction of movement along the fold line) is arranged outside the pressing member arrangement region (i.e., outside the additional folding roller 114 at the other end position in the pressing member arrangement region). Further, through moving the plurality of additional folding rollers 114 along the fold line of the sheet with respect to the lower folding guide 111 at the pressing position by the second moving mechanism 117, the fold line of the sheet is pressed over the entire area of the fold line by the plurality of additional folding rollers 114 to perform additional folding, thereby reinforcing the fold line.

In this manner, each additional folding roller 114 and the lower folding guide 111 function as a pressing member.

Further, regulating members 115 having a substantially L-shaped cross section and attached to the support member 112 are respectively arranged on the outer side of the additional folding rollers 114 at both end positions and between the additional folding rollers 114 adjacent to each other in a spaced manner. The regulating members 115 are arranged at a regulating position where distance dl between a bottom surface of the regulating member 115 (i.e., a surface facing the lower folding guide 111) and an upper surface of the lower folding guide 111 is shorter than height of a normal conveyance path, for example, distance d2 between the conveyance guide pair 118 (upper conveyance guide 118*a* and lower conveyance guide 118*b*) forming the conveyance path following the conveyance port 119 of the additional folding unit 104 during additional folding processing by moving the additional folding rollers 114 along the fold line of the sheet at the pressing position with respect to the lower folding guide 111. The regulating member 115 moves along the fold line of the sheet together with the support member 112 while maintaining the distance d1. Here, the distance d1 between the bottom surface of the regulating member 115 and the upper surface of the lower folding guide 111 is determined so that these members do not come into direct contact with each other. According to the above, prior to the pressing by the additional folding rollers 114, the regulating member 115 presses down the fold line so that the height of the fold line is lower than the distance between the upper conveyance guide 118*a* and the lower conveyance guide 118*b*, and the additional folding can be performed by pressing the fold line of the sheet by the additional folding rollers 114 in such a state.

The gap between the plurality of additional folding rollers 114 and the lower folding guide 111 and the gap between the regulating member 115 and the lower folding guide 111 are each kept constant over the entire region in the direction along the fold line of the sheet.

It is preferable that each of the plurality of additional folding rollers 114 is rotatably attached to an auxiliary member (not illustrated) movably supported with respect to the support member 112, and springs (not illustrated) are arranged respectively between a spring receiving portion (not illustrated) formed in the support member 112 and an upper end portion of each of the auxiliary members to urge the additional folding rollers 114 toward the lower folding guide 111. With this configuration, when the support member 112 of the additional folding unit 104 and the regulating member 115 attached thereto move downward toward the lower folding guide 111, the additional folding rollers 114 stop moving downward when contacting the lower folding guide 111 via a sheet, while the support member 112 and the regulating member 115 can continue moving downward owing to contraction of the spring, and can stop when the regulating member 115 reaches a regulating position where the distance between the bottom surface of the regulating member 115 and the upper surface of the lower folding guide 111 obtains a desired value. In addition, even when the support member 112 moves along a fold line of a sheet while being slightly inclined, owing to that each of the auxiliary members is urged by the springs individually, each of the additional folding rollers 114 can apply constant pressing force to the fold line of the sheet, and it is possible to suppress uneven additional folding due to a change in the pressing force among parts of the fold line.

Next, detailed configurations of the first moving mechanism 116 and the second moving mechanism 117 in the illustrated embodiment will be described.

The support member 112 of the additional folding unit 104 is attached to a slider 124, which is movable along a guide rail 123 fixed to a housing 122 or the like of the sheet folding processing apparatus B, via a bracket 125 so as to be vertically movable, and moves in conjunction with the slider 124 in the horizontal direction. A rack 127 that engages with a pinion (not illustrated) that rotates integrally with a pulley 126 is provided on the slider 124, and the slider 124 can be moved along the guide rail 123 in the horizontal direction by driving an additional folding motor 128 and transmitting rotation thereof to the pulley 126 via a belt 129 to rotate the pulley 126.

The support member 112 is formed with a cam groove 131 that engages with a contactor 130 fixed to the housing 122 or the like of the sheet folding processing apparatus B. With the horizontal movement of the support member 112, the cam groove 131 moves while engaging with the contactor 130, and the support member 112 moves while being guided following a shape of the cam groove 131. The cam groove 131 includes a first bottom horizontal portion extending approximately horizontally, a first inclined portion extending obliquely upward from an end of the first bottom horizontal portion, a top horizontal portion extending approximately horizontally from an end of the first inclined portion, a second inclined portion extending obliquely downward from an end of the top horizontal portion, and a second bottom horizontal portion extending approximately horizontally from an end of the second inclined portion. By moving the support member 112 in the horizontal direction in FIG. 3 with respect to the housing 122 by the slider 124 while engaging the first inclined portion and the second inclined portion of the cam groove 131 with the contactor 130, the support member 112 moves in a direction approaching and separating from the lower folding guide 111, that is, in the vertical direction in FIG. 3. Thus, the guide rail 123, the slider 124, the bracket 125, the pulley 126, the rack 127, the additional folding motor 128, the belt 129, the contactor 130, and the first inclined portion and the second inclined portion of the cam groove 131 constitute a first moving mechanism 116. By moving the support member 112 in the horizontal direction in FIG. 3 with respect to the housing 122 by the slider 124 while engaging the top horizontal portion of the cam groove 131 with the contactor 130, the support member 112 and the plurality of additional folding rollers 114 supported by the support member 112 move along the fold line of the sheet in the horizontal direction in FIG. 3 with respect to the lower folding guide 111. Thus, the guide rail 123, the slider 124, the bracket 125, the pulley 126, the rack 127, the additional folding motor 128, the belt 129, the contactor 130, and the top horizontal portion of the cam groove 131 constitute a second moving mechanism 117. In the illustrated embodiment, the contactor 130 is fixed to the housing 122 or the like, and the cam groove 131 is formed in the support member 112. However, it is obvious that the contactor 130 may be fixed to the support member 112, and the cam groove 131 may be formed in the housing 122.

In the case that the plurality of additional folding rollers 114 are arranged at regular intervals as in the illustrated embodiment, in order to press all of the fold lines positioned between each of the adjacent additional folding rollers 114 between the additional folding rollers 114 and the lower folding guide 111, it is necessary to move the plurality of additional folding rollers 114 along the fold lines with respect to the lower folding guide 111 at the pressing position by the interval of the adjacent additional folding rollers 114 (i.e., a distance of one pitch) or more. In the above-described configuration of the first moving mechanism 116, by moving the slider 124 in the horizontal direction while engaging the contactor 130 with the first inclined portion of the cam groove 131, the plurality of additional folding rollers 114 supported by the support member 112 approach the lower folding guide 111 and move to the pressing position. In the above-described configuration of the second moving mechanism 117, by moving the slider 124 in the horizontal direction while engaging the contactor 130 with the top horizontal portion of the cam groove 131, the plurality of additional folding rollers 114 supported by the support member 112 move along the fold line at the pressing position. Therefore, length of the top horizontal portion of the cam groove 131 in the horizontal direction (direction along the fold line) is equal to or larger than one pitch of the adjacent additional folding rollers 114.

Next, operation of the additional folding unit 104 of the illustrated embodiment will be briefly described with reference to FIGS. 4A and 4B. Here, description will be given on the assumption that a sheet having a fold line 132 formed at a front end thereof by the folding roller pair 105 is conveyed into the additional folding unit 104.

Figure 4A:
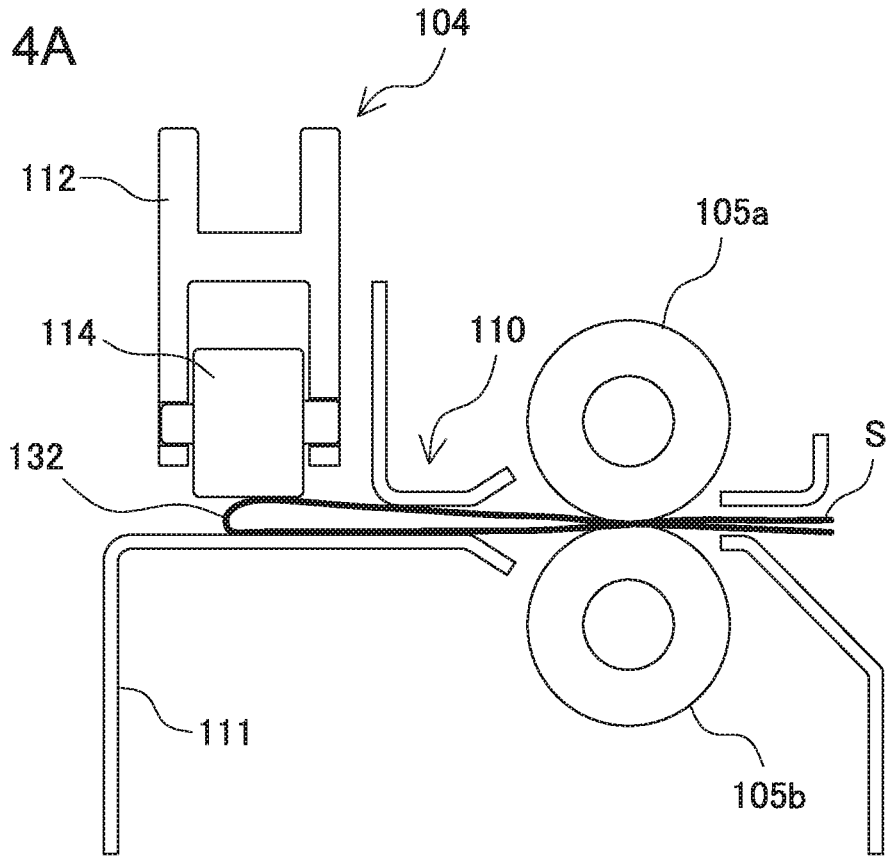
FIGS. 4A and 4B are views for explaining operation of the additional folding unit illustrated in FIG. 3.

When the sheet from the folding processing mechanism 103 is received into the additional folding unit 104 through the conveyance path constituted by the conveyance port 119, the upper conveyance guide 118*a*, and the lower conveyance guide 118*b*, as illustrated in FIG. 4A, the plurality of additional folding rollers 114 supported by the support member 112 are arranged at the receiving position which is the home position. When the position of the sheet is detected by a sheet position detecting unit (not illustrated) provided on the upstream side of the folding roller pair 105 and it is recognized that the fold line 132 on the front end side in the conveyance direction of the sheet conveyed into the conveyance port 119 from the folding roller pair 105 reaches the pressing position below the additional folding rollers 114 as illustrated in FIG. 4A, the conveyance of the sheet is stopped and the support member 112 is moved in the horizontal direction together with the slider 124 by driving the additional folding motor 128. Thus, the portion where the contactor 130 engages with the cam groove 131 moves from the first bottom horizontal portion to the first inclined portion, and thereby the support member 112 moves downward toward the lower folding guide 111, and as illustrated in FIG. 4B, the plurality of additional folding rollers 114 supported by the support member 112 move to the pressing position where the first fold line 132 of the sheet is sandwiched and pressed between the plurality of additional folding rollers 114 and the lower folding guide 111.

Figure 4B:
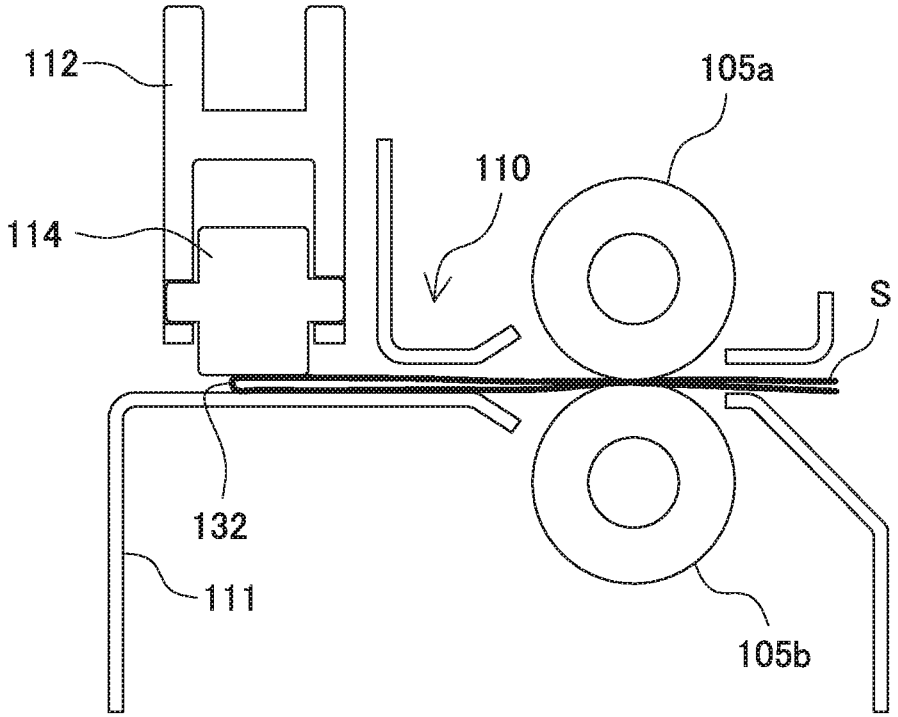

When the support member 112 is further moved in the horizontal direction together with the slider 124 by driving the additional folding motor 128 from the state illustrated in FIG. 4B, the portion where the contactor 130 engages with the cam groove 131 moves from the first inclined portion to the top horizontal portion. Then, while the regulating member 115 attached to the support member 112 regulates thickness of the first fold line 132 of the sheet to a predetermined thickness (corresponding to the distance d1) or less, the plurality of additional folding rollers 114 supported by the support member 112 move at the pressing position along the fold line 132 of the sheet with respect to the lower folding guide 111 by distance equal to or larger than one pitch of the plurality of additional folding rollers 114, and the leading additional folding roller 114 in the moving direction moves over the other end of the first fold line 132 of the sheet (a downstream side end in the moving direction of the additional folding rollers 114 in the outward route). In this manner, the fold line 132 is pressed over the entire area by the additional folding rollers 114 and the lower folding guide 111 to reinforce the fold line 132, that is, to perform additional folding.

When the support member 112 is further moved in the horizontal direction together with the slider 124 by driving the additional folding motor 128 from this state, the portion where the contactor 130 engages with the cam groove 131 moves from the top horizontal portion to the second bottom horizontal portion via the second inclined portion. As a result, the support member 112 rises together with the regulating member 115 in a direction separating from the lower folding guide 111, and the plurality of additional folding rollers 114 supported by the support member 112 move to the first retracting position located above while approaching the position where the pressing is finished, and the additional folding processing is completed. Here, the first retracting position is different from the receiving position, which is the home position.

[Control Configuration of Sheet Folding Processing Apparatus]

Figure 5:
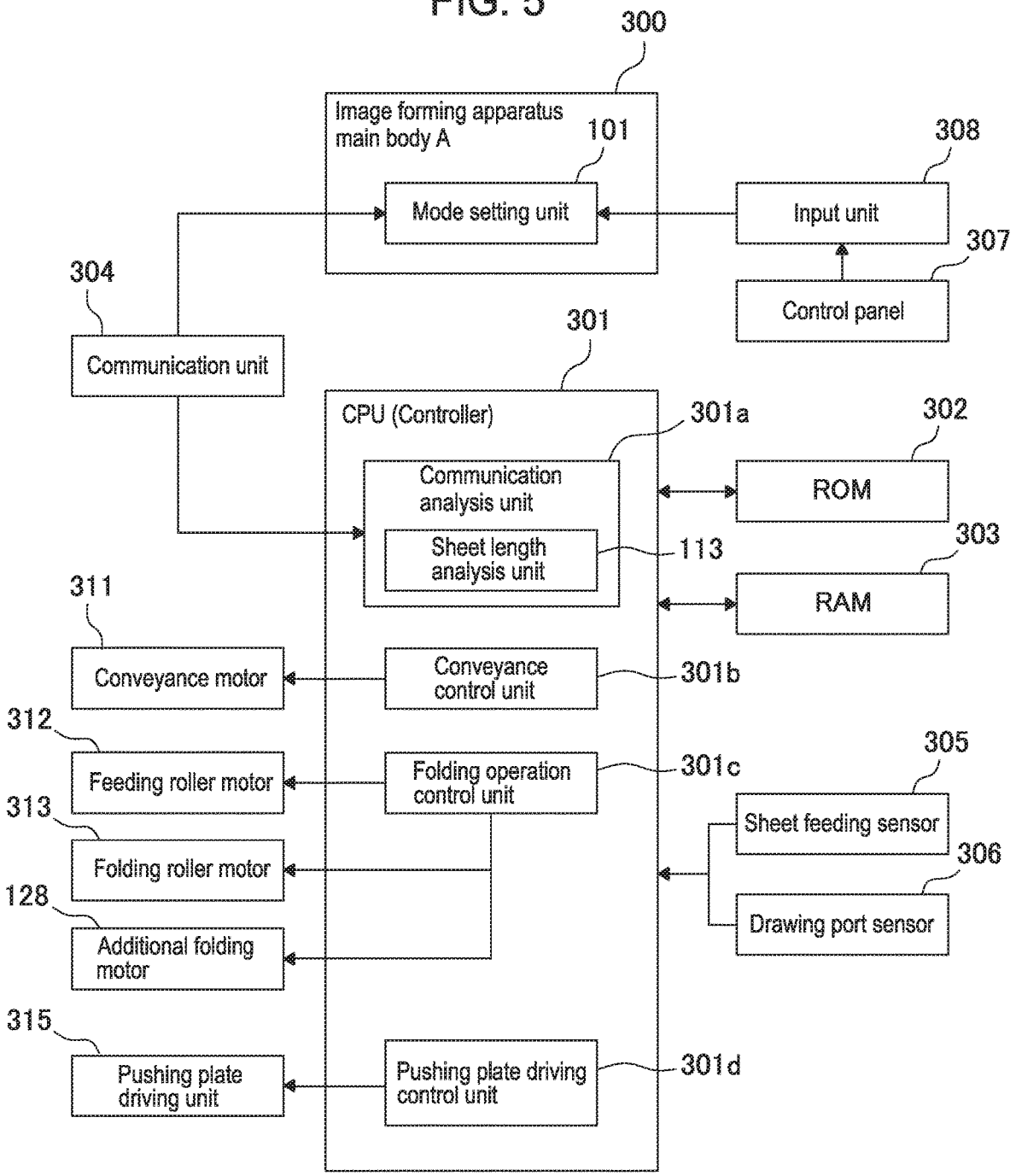
FIG. 5 is a block diagram of a control configuration of the folding processing apparatus.

FIG. 5 conceptually shows a control configuration of the sheet folding processing apparatus B. The sheet folding processing apparatus B includes a controller 301 configured of a control board including a CPU. The controller 301 is connected to a ROM 302 storing a folding control program and a storage unit 303 configured of a RAM. The folding control program is called from the ROM 302, and realizes functions of a communication analysis unit 301*a*, a conveyance control unit 301*b*, a folding operation control unit 301*c*, and a pushing plate driving control unit 301*d* by executing the above-described processing while storing temporary information in the storage unit 303 as necessary.

As illustrated in FIG. 5, a sheet feeding sensor 305 and a drawing port sensor 306 provided along the conveyance path 101 are connected to the controller 301. The sheet feeding sensor 305 is arranged upstream of the feeding roller pair 102, and the drawing port sensor 306 is arranged near the sheet drawing port 113 on the upstream side of the folding roller pair 105.

The controller 301 is connected to the conveyance motor 311 for drawing a sheet from the image forming apparatus A into the sheet folding processing apparatus B, the feeding roller motor 312 for driving the feeding roller pair 102, the folding roller motor 313 for driving the folding roller pair 105, the additional folding motor 128, and a pushing plate driving portion 315 for moving the pushing plate 107, and controls driving of the motors and the pushing plate driving portion 315 based on the detection result input from a communication unit 304 and various information received from the image forming apparatus A.

Figure 6:
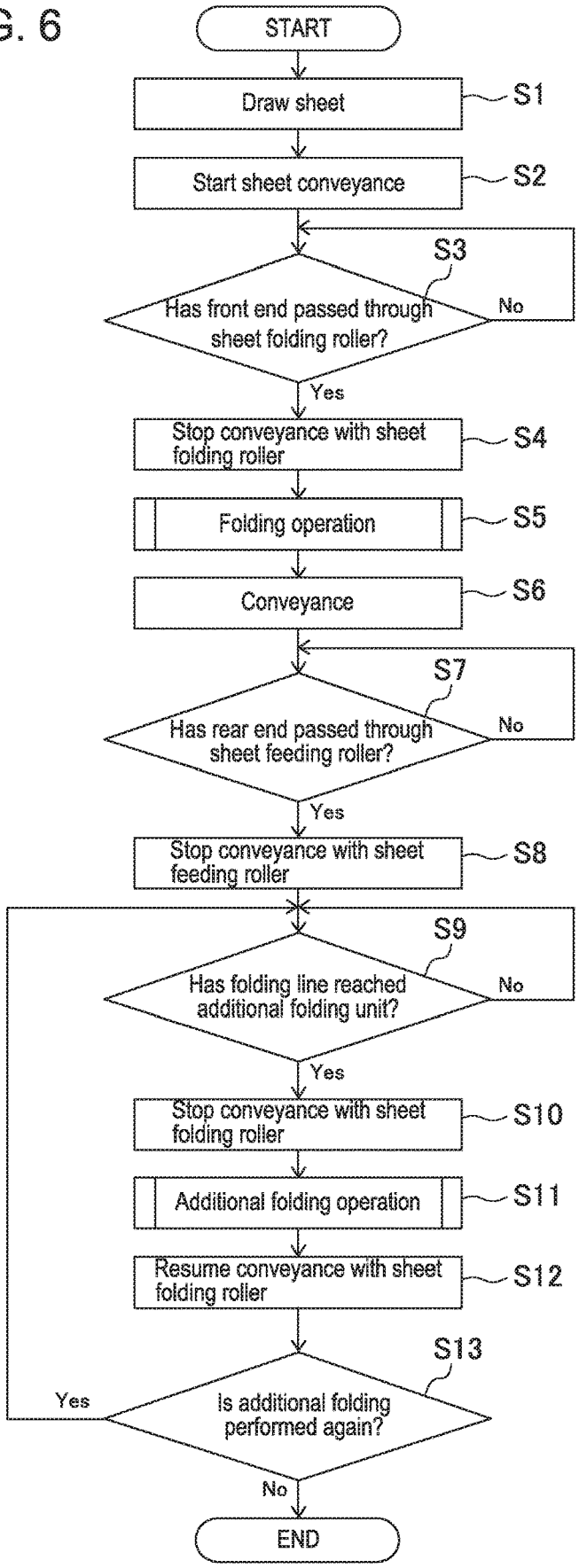
FIG. 6 is a flowchart for explaining procedure of folding processing operation.

The folding processing and the additional folding processing of the sheet folding processing apparatus B will be specifically described below with reference to a flowchart illustrated in FIG. 6. Here, description will be given on a flow of performing the folding processing and the additional folding processing on two portions of the sheet in order to perform triple (Z) folding on one sheet. In a case that triple (Z) folding is performed on a plurality of sheets, the flow illustrated in FIG. 6 is repeated.

The controller 301 analyzes a command from the controller 300 received from the communication unit 304 with the communication analysis unit 301*a*, and when the command is an instruction to perform folding operation, the conveyance control unit 301*b* drives the conveyance motor 311 to draw a sheet until the sheet feeding sensor 305 detects a sheet fed from the image forming apparatus A (step S1).

Figure 7:
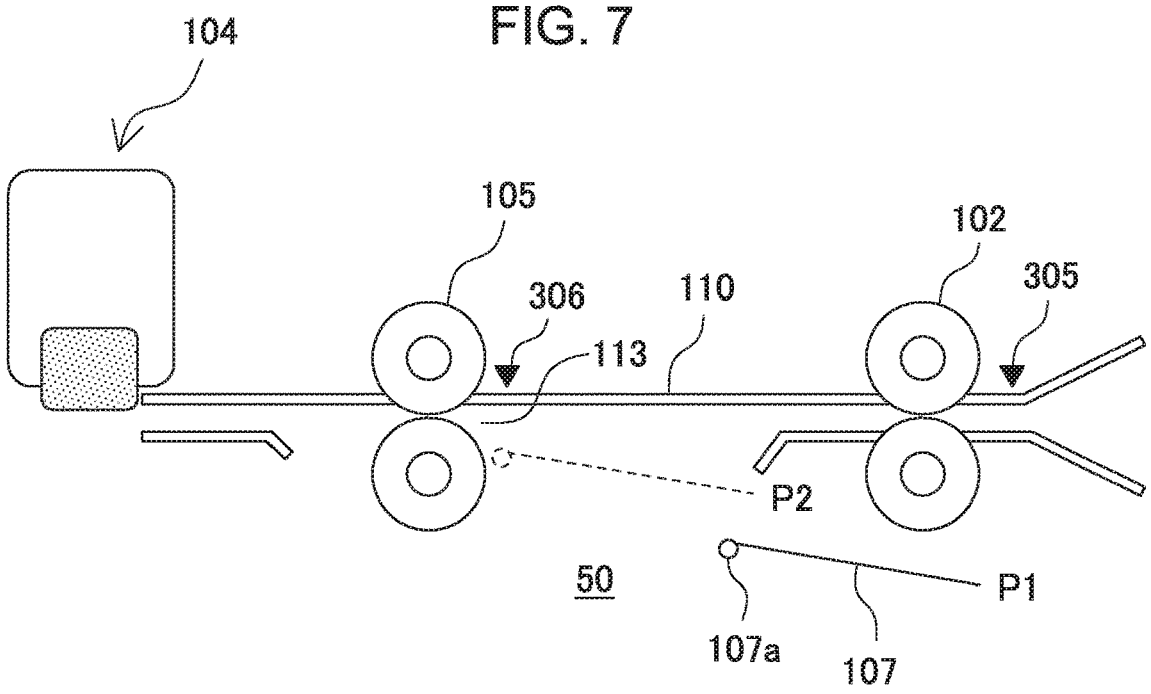
FIG. 7 is a view for explaining operation of folding processing.

When the sheet is drawn, the controller 301 drives the feeding roller motor 312 by the folding operation control unit 301*c* to draw and convey the sheet into the conveyance path 101 (step S2). The folding operation control unit 301*c* detects a sheet feeding amount by the feeding roller pair 102 with a rotation number counting unit (not illustrated). Here, a counter may be provided in the folding operation control unit 301*c* instead of the rotation number counting unit. At this time, the pushing plate 107 is at a second position P2 indicated by a broken line in FIG. 7.

When the drawing port sensor 306 detects the sheet, the controller 301 drives the pushing plate driving unit 315 by the pushing plate driving control unit 301*d* to move the pushing plate 107 toward the first position P1, and the folding operation control unit 301*c* drives the folding roller motor 313 to operate the folding roller pair 105. At this time, the folding operation control unit 301*c* detects the sheet feeding amount by the rotation number counting unit (not illustrated), and when a predetermined amount of the sheet is drawn into the folding roller pair 105 and a front end of the sheet is nipped by the folding roller pair 105 ("YES" in step S3), the folding roller motor 313 is controlled to temporarily stop the folding roller pair 105 (step S4).

Figure 8:
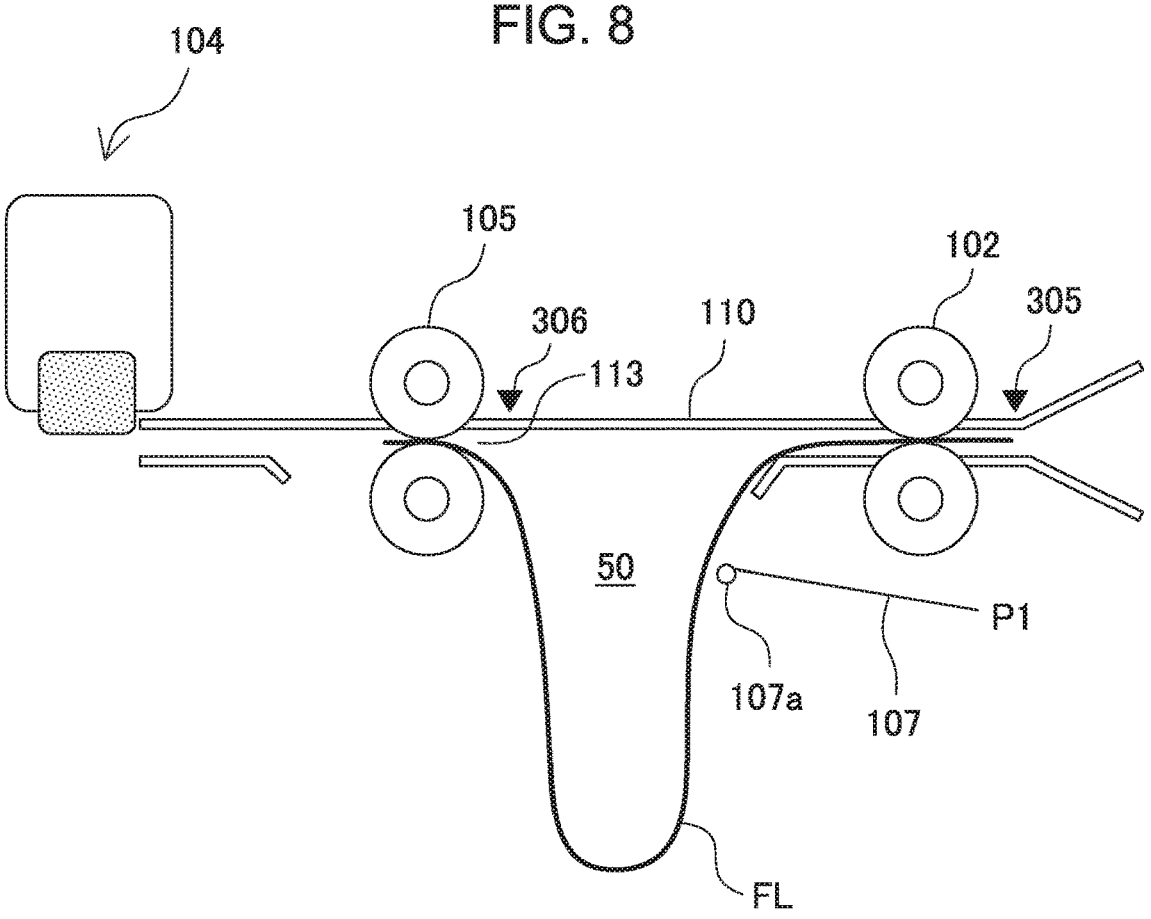
FIG. 8 is a view for explaining operation of folding processing.

On the other hand, even while the folding roller pair 105 is stopped, the feeding roller pair 102 continues to feed the sheet until the conveyance control unit 301*b* detects a predetermined number of rotation. At this time, the pushing plate 107 is at the first position P1 as illustrated in FIG. 8, and the portion of the sheet on the upstream side of the folding roller pair 105 curves in a loop shape and hangs down in the loop forming space 50. Thus, a folding loop FL for forming a fold line on the sheet is formed. Thereafter, the folding loop FL is enlarged in accordance with the amount of the sheet fed by the feeding roller pair 102.

Then, the pushing plate driving control unit 301*d* drives the pushing plate driving unit 315 to move the pushing plate 107 to the second position P2 right before the nipping portion of the folding roller pair 105, and the folding operation control unit 301*c* drives the folding roller motor 312 to re-drive the folding roller pair 105, thereby performing the folding operation processing (step S5). At this time, a front end of the pushing plate 107 abuts against the folding loop FL, and a predetermined portion of the sheet which is abutted and pressed by the sheet drawing guide roller 107*a* becomes a folding position which is to be a fold line of the sheet and is drawn into the sheet drawing port 113 of the folding roller pair 105, and thereby triple (Z) folding is performed on the sheet.

The folding roller pair 105 and the feeding roller pair 102 continue to feed the sheet (step S6), and when a rear end of the sheet is fed by a predetermined amount after passing through the sheet feeding sensor 305 ("YES" in step S7), the folding operation control unit 301*c* controls the driving of the feeding roller motor 312 to stop the feeding roller pair 102, and the pushing plate driving control unit 301*d* controls the pushing plate driving unit 315 to move the pushing plate 107 to the first position P1 (step S8).

Figure 9:
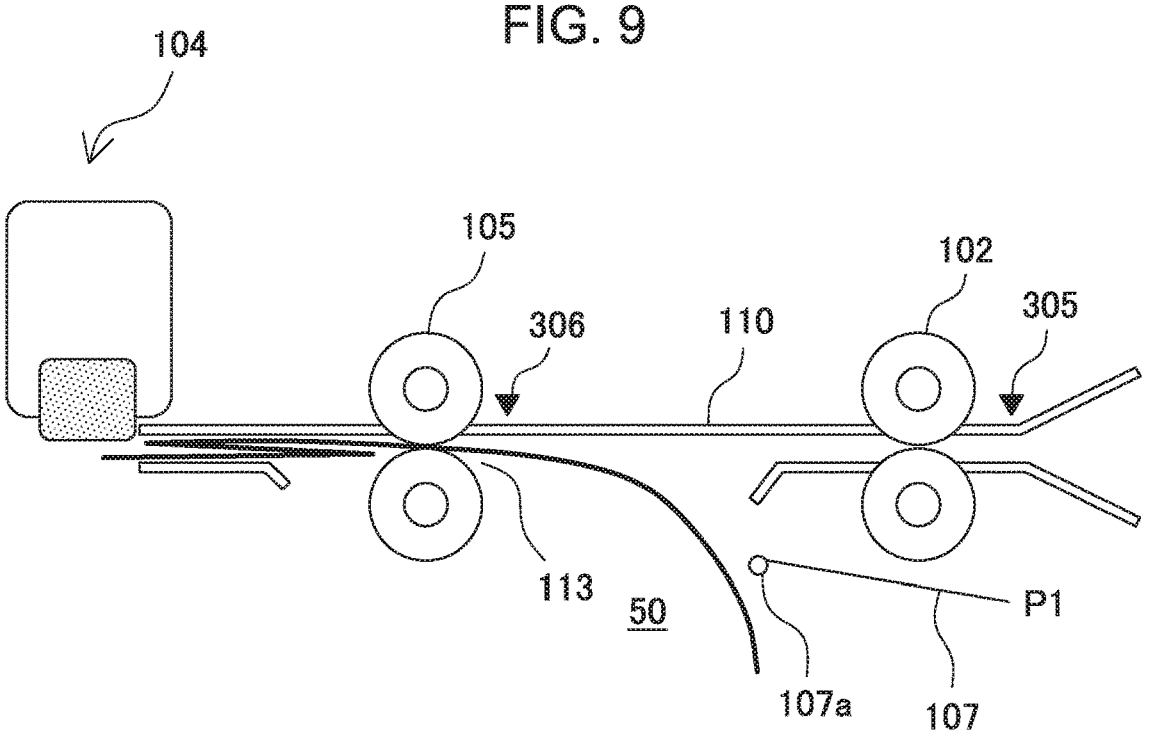
FIG. 9 is a view for explaining operation of folding processing.

As described above, at the time when the rear end of the sheet passes through the feeding roller pair 102 which is a conveyance unit, driving of the feeding roller motor 312 is stopped and the pushing plate 107 is moved to the first position P1 which is the retracting position. Therefore, when the pushing plate 107 also serving as a lower guide of the conveyance path 101 returns to the retracting position, the sheet is held in the loop forming space 50 in a state in which the rear end of the sheet hangs down in the loop forming space 50 as illustrated in FIG. 9.

Then, the folding operation control unit 301*c* controls driving of the folding roller motor 313 so that the folding roller pair 105 is stopped (step S10) when the rotation number counting unit detects that the triple (Z) folded sheet is conveyed by the folding roller pair 105, so that the fold line on the front end side reaches the additional folding unit 104 (step S9). Subsequently, the folding operation control unit 301*c* controls driving of the additional folding motor 128 to perform the reinforcing processing on the fold line of the sheet by the additional folding unit 104 (step S11).

After the additional folding of the fold line on the front end side is completed, it is determined whether or not the reinforcing processing of the fold line of the sheet is to be further performed (step S13). If triple (Z) folding has been performed on the sheet, the additional folding processing is to be performed on the second fold line ("YES" in step S13). The folding operation control unit 301*c* resumes the sheet conveyance operation of the folding roller pair 105. After the sheet is conveyed by the predetermined amount, driving of the folding roller motor 313 is controlled to stop the folding roller pair 105 (step S10). Subsequently, the folding operation control unit 301*c* controls driving of the additional folding motor 128 to perform the reinforcing processing on the fold line of the sheet by the additional folding unit 104 (step S11). After the additional folding on the second fold line is completed, the folding operation control unit 301*c* resumes the sheet conveyance operation of the folding roller pair 105, and the sheet is discharged to the post processing apparatus C arranged at the downstream side. The Z-folding operation on the sheet is completed through the above. Thereafter, when the sheet feeding sensor 305 detects a subsequent sheet fed from the image forming apparatus A, processing returns to step S3, and the above-described operation is repeated.

Here, a timing at which the feeding roller pair 102 is stopped when the sheet is fed by the predetermined amount after the sheet feeding sensor 305 detects the passage of the rear end of the sheet (step S8) and a timing at which the folding roller pair 105 is stopped when the fold line on the front end side of the triple (Z) folded sheet is fed by a predetermined amount to reach the additional folding unit 104 to perform the fold line reinforcing processing by the additional folding unit 104 (step S11) may be switched.

In the processing flow from step S7 to step S13 described above, a characteristic point is that, at the time when the rear end of the sheet passes through the feeding roller pair 102 which is a conveyance unit, driving of the feeding roller motor 312 is stopped and the pushing plate 107 is moved to the first position P1 which is the retracting position, thereby holding the sheet in the loop forming space 50. As a result, the feeding roller pair 102 can be ready to receive a subsequent sheet from the image forming apparatus A only after the rear end of the sheet passes therethrough. Therefore, even if a subsequent sheet is fed from the image forming apparatus A during the additional folding operation, the sheet can be received by the sheet folding processing apparatus B without being held in a standby state, and there is no need to provide a buffer path such as a switchback path and a bypass path.

Here, at the time of moving the pushing plate 107 to the first position P1 which is the retracting position, in a case that a triple (Z) folded sheet is long and a rear end thereof cannot be retracted into the loop forming space 50 even when the rear end passes through the feeding roller pair 102, the rear end of the sheet can be retracted into the loop forming space 50 through conveying the sheet by a specific distance by the folding roller pair 105 until the rear end of the sheet exceeds the sheet drawing guide roller 107*a* arranged at the front end of the pushing plate 107 and subsequently performing switchback conveyance in an opposite direction. At this time, in a case that the front end of the triple (Z) folded sheet causes an influence such as turning on a sensor of an apparatus connected downstream owing to the conveyance of the sheet by the specific distance before the switchback, the specific distance for the conveyance is set not to cause an influence on the apparatus connected downstream.

Figure 10:
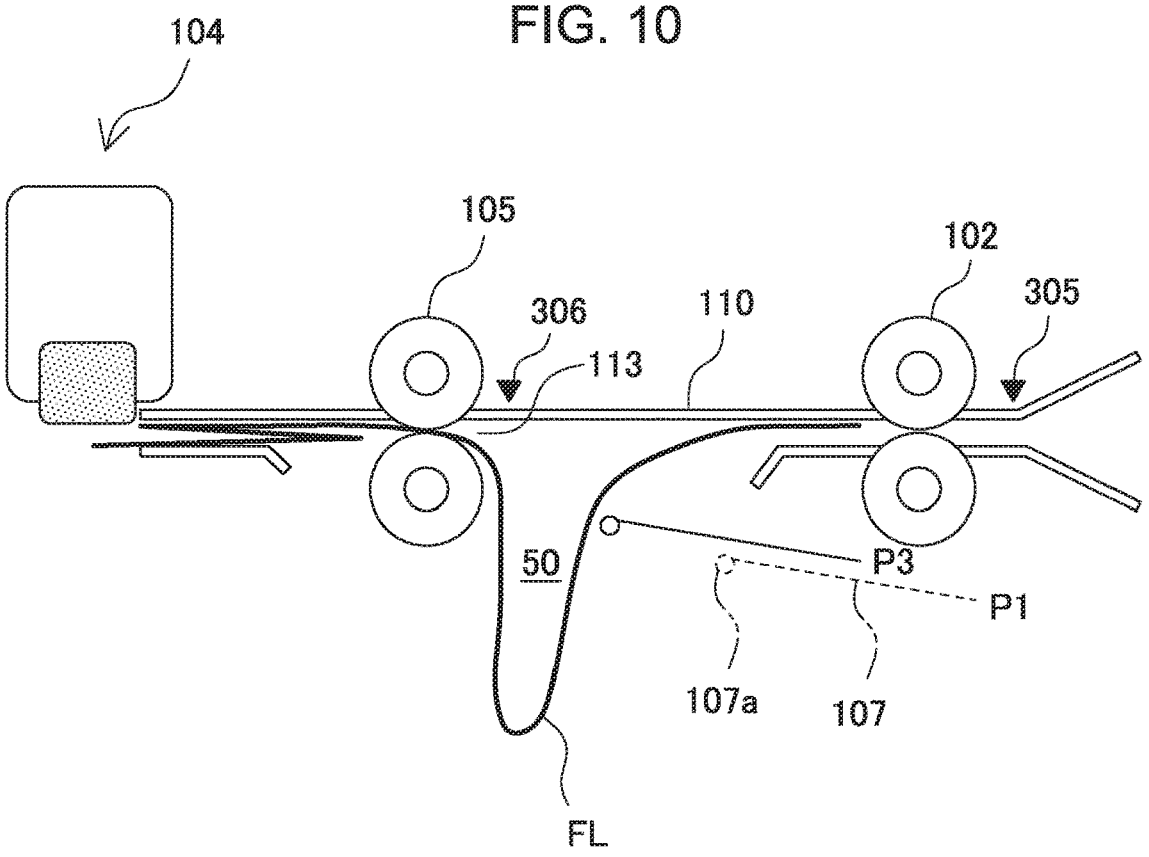
FIG. 10 is a view for explaining operation of folding processing.

Further, in the processing of step S4, when the pushing plate 107 is moved from the second position P2 to the first position P1, in a case that the sheet length of the triple (Z) folded sheet is longer than a predetermined length, the shape of the downward folding loop FL becomes large and movement to the loop forming space 50 is facilitated by the weight of the sheet, and therefore, as illustrated in FIG. 10, it is preferable that the pushing plate 107 is retracted to a third position P3 downstream of the first position P1. From the third position P3, the moving distance of the pushing plate 107 to the second position P2 for pushing the fold line portion of the sheet into the nipping portion of the folding roller pair 105 is shortened, and fold line processing time can be shortened.

Figure 11:
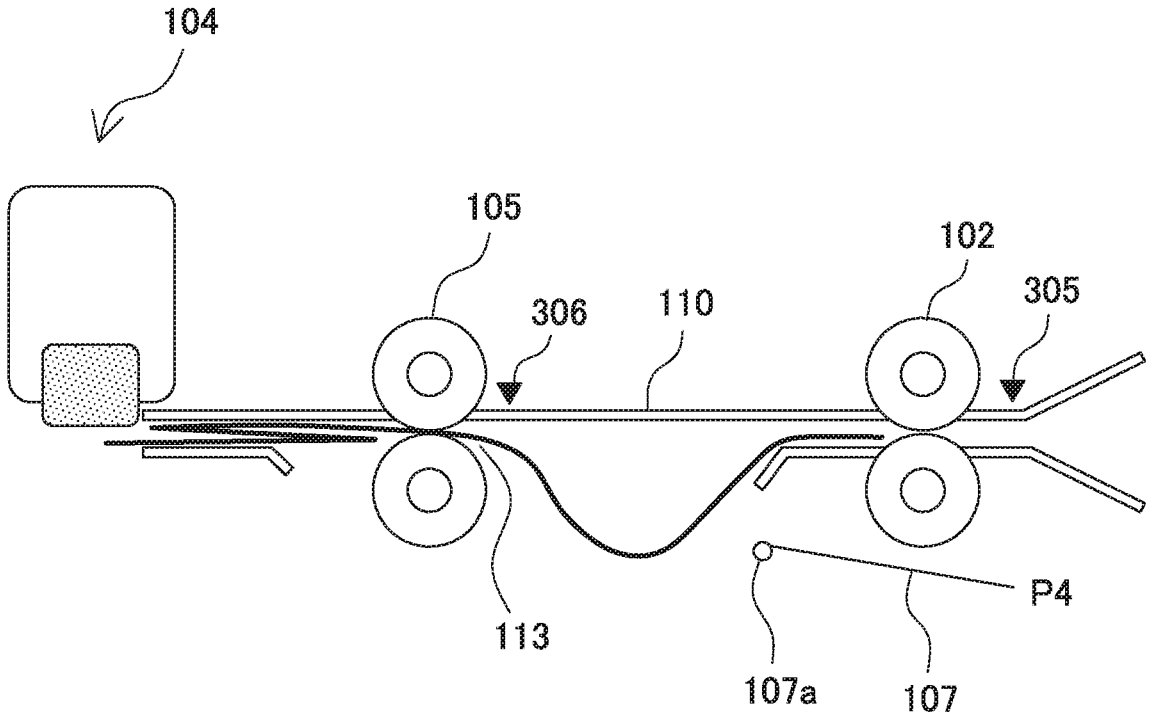
FIG. 11 is a view for explaining operation of folding processing.

In contrast, in a case that the sheet length of the triple (Z) folded sheet is shorter than the predetermined length, the shape of the downward folding loop FL becomes small and movement to the loop forming space 50 by the weight of the sheet becomes difficult, and therefore, it is possible to prevent contact of the sheet with the pushing plate 107 through retracting the pushing plate 107 to a fourth position P4 upstream of the first position P1, as illustrated in FIG. 11.

Figure 12:
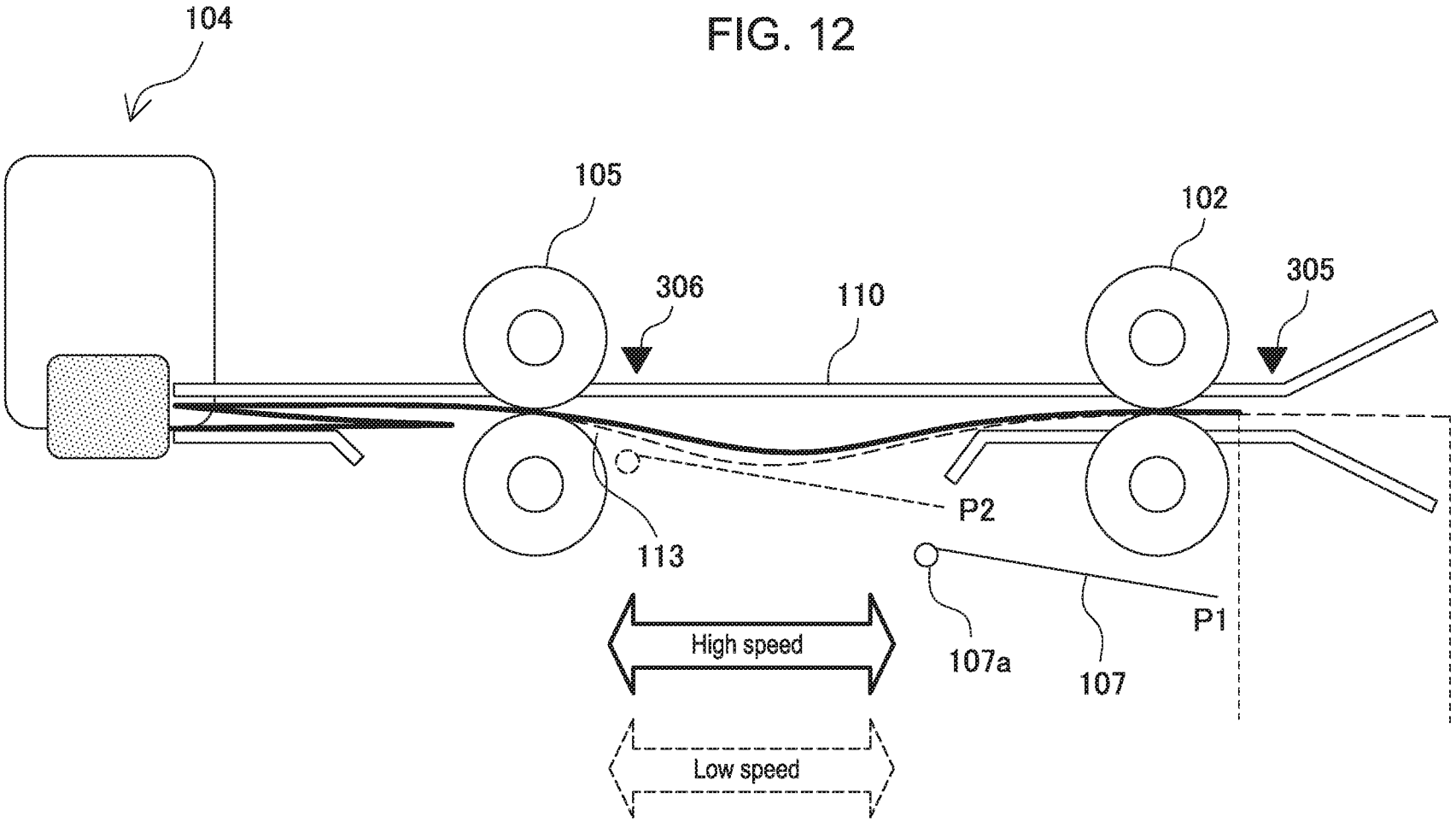
FIG. 12 is a view for explaining operation of folding processing.

Further, when the pushing plate 107 is moved from the second position P2 to the first position P1, in the case that the sheet length of the triple (Z) folded sheet is shorter than the predetermined length, time until the rear end of the sheet passes through the feeding roller pair 102 is short, and therefore, as illustrated in FIG. 12, the pushing plate 107 starts to move at an earlier timing or at a faster speed to avoid contact between the pushing plate 107 and the sheet, thereby enabling prevention of damage on the sheet and smooth retracting of the rear end of the sheet to the loop forming space 50 at the time of the folding processing.

Figure 13:
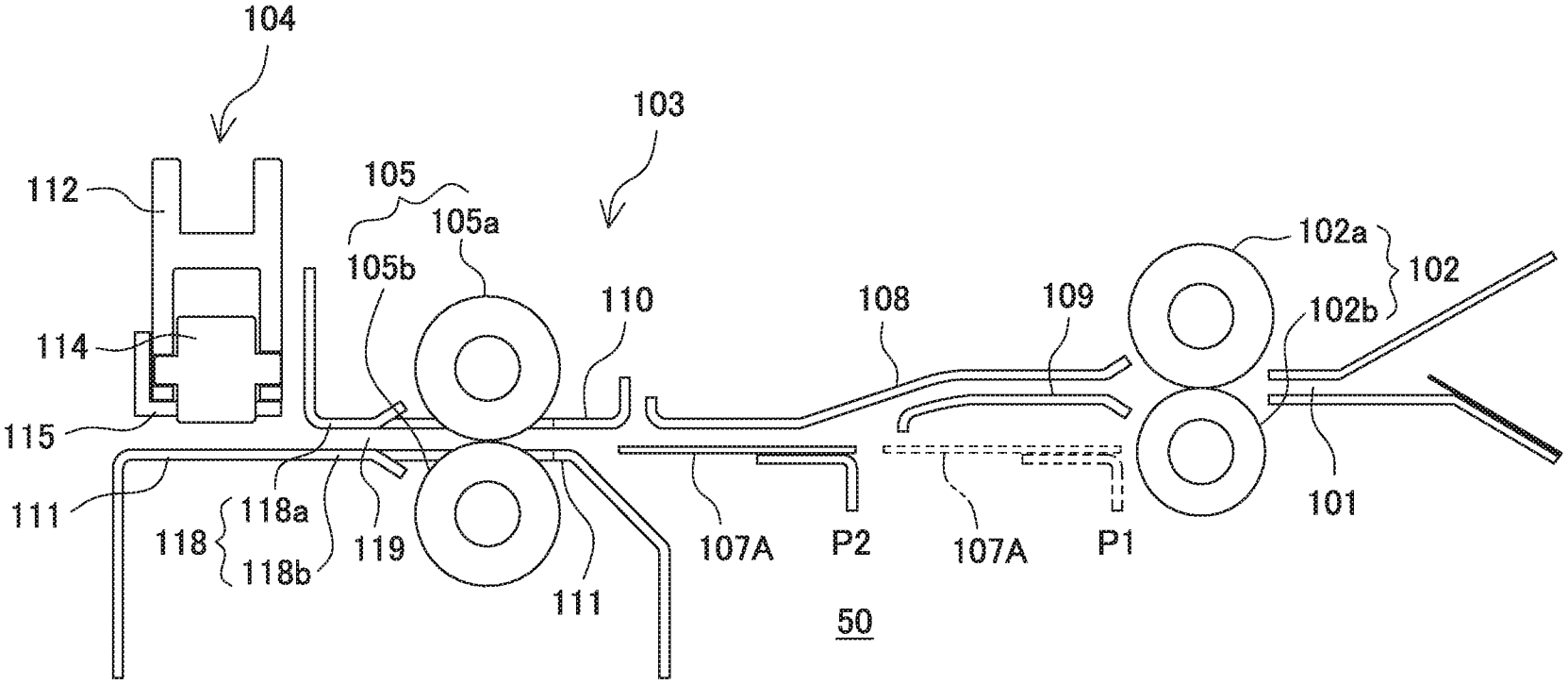
FIG. 13 is an explanatory view of another embodiment of a pushing plate in the folding processing apparatus.

FIG. 13 illustrates an embodiment in which a pushing plate reciprocates horizontally. The pushing plate member 107A in FIG. 13 is arranged between the feeding roller pair 102 and the folding roller pair 105, and moves between the first position P1 and the second position P2 in parallel with the conveyance path 101 on the upstream side of the folding roller pair 105 in accordance with driving of a pushing plate driving motor (not illustrated). The pushing plate member 107A is arranged so as to fill the loop forming space 50 between the lower conveyance guide 109 and the lower folding guide 111 when the sheet is conveyed to the folding roller pair 105 by the feeding roller pair 102 along the conveyance path 101, and guides the front end of the conveyed sheet to the lower folding guide 111. When the front end of the conveyed sheet is nipped by the folding roller pair 105, in order to form the folded portion, the pushing plate member 107A moves in the horizontal direction to the first position P1 indicated by a broken line below the lower conveyance guide 109, and opens the loop forming space 50 between the lower conveyance guide 109 and the lower folding guide 111.

Then, when the feeding roller pair 102 conveys the sheet by a predetermined amount in a state where the front end of the sheet is nipped by the folding roller pair 105, the intermediate portion of the sheet is bent downward in the loop forming space 50 to form a loop portion. In this state, the pushing plate member 107A is moved in the horizontal direction from the first position P1 which is the retracting position toward the folding roller pair 105 to form the folded portion, and after the pushing plate member 107A reaches the second position P2 in front of the folding roller pair 105, the folding roller pair 105 is driven to convey the sheet, thereby forming a first fold line. Further, after the pushing plate member 107A is moved to the first position P1, the sheet is conveyed by the folding roller pair 105 to nip the loop portion, thereby a fold line is formed and the triple (Z) folded sheet is conveyed to the downstream side.

As described above, the pushing plate 107A pushes the sheet into the folding roller pair 105 by reciprocating in the horizontal direction, and appropriately forms a bottom plate between the lower conveyance guide 109 and the lower folding guide 111 in the conveyance path 101. Thus, at the time when the rear end of the sheet passes through the feeding roller pair 102, driving of the feeding roller motor 312 is stopped and the pushing plate member 107A is moved to the first position P1 which is the retracting position, thereby holding the sheet in the loop forming space 50. Therefore, the feeding roller pair 102 can be ready to receive a subsequent sheet from the image forming apparatus A after the rear end of the sheet has passed, and even if the subsequent sheet is fed from the image forming apparatus A during the additional folding operation, the sheet can be received by the sheet folding processing apparatus B without being held in a standby state, thereby improving productivity.

Similarly to the above-described pushing plate 107, in the case of the pushing plate member 107A as well, the time for moving the pushing plate member 107A to the second position P2 in the fold line forming processing for the subsequent sheet can be shortened by appropriately returning the pushing plate member 107A to the retracting position after forming the first fold line to a position between the first position P1 and the second position P2 according to the length of the sheet.

In the above, the present invention has been described with reference to the preferred embodiments. However, the present invention is not limited to the above-described embodiments, and it is obvious that various changes or modifications can be made within the technical scope of the present invention.

The invention claimed is:

1. A sheet folding processing apparatus comprising:

a conveyance unit which conveys a sheet in a conveyance direction;

a folding unit including a nipping portion which performs folding processing to nip a predetermined part of the sheet conveyed by the conveyance unit and to form a fold line at the predetermined part;

a loop forming space for forming a loop on the sheet between the conveyance unit and the folding unit;

a pushing plate which contacts the loop formed in the loop forming space and is movable between a guide position for guiding the predetermined part to the nipping portion of the folding unit and a retracting position closer to the conveyance unit than the guide position; and an additional folding unit which performs fold line reinforcing processing to reinforce the fold line formed by the folding unit, wherein the conveyance unit conveys the sheet in the conveyance direction after the folding processing is performed on the sheet by the folding unit, and the additional folding unit performs the fold line reinforcing processing on the fold line after a rear end of the sheet in the conveyance direction passes through the conveyance unit.

2. The sheet folding processing apparatus according to claim 1, wherein the rear end of the sheet in the conveyance direction is retracted into the loop forming space while the fold line reinforcing processing is performed on the fold line at the additional folding unit.

3. The sheet folding processing apparatus according to claim 1, wherein a timing at which the pushing plate starts to move toward the retracting position when length of the sheet in the conveyance direction after the folding processing is performed on the sheet by the folding unit is longer than a predetermined length is delayed as compared to that when length of the sheet in the conveyance direction after the folding processing is performed on the sheet by the folding unit is shorter than the predetermined length.

4. The sheet folding processing apparatus according to claim 1, wherein the retracting position of the pushing plate is set closer to the conveyance unit when length of the sheet in the conveyance direction after the folding processing is performed on the sheet by the folding unit is longer than a predetermined length than that when length of the sheet in the conveyance direction after the folding processing is performed on the sheet by the folding unit is shorter than the predetermined length.

5. The sheet folding processing apparatus according to claim 1, wherein a moving speed of the pushing plate toward the retracting position is set slower when length of the sheet in the conveyance direction after the folding processing is performed on the sheet by the folding unit is longer than a predetermined length than that when length of the sheet in the conveyance direction after the folding processing is performed on the sheet by the folding unit is shorter than the predetermined length.

6. The sheet folding processing apparatus according to claim 1, wherein, in a case that the retracting position of the pushing plate is at a position where the rear end of the sheet in the conveyance direction is incapable of being retracted into the loop forming space even when the rear end of the sheet in the conveyance direction passes through the conveyance unit, the folding processing is performed on the sheet by the folding unit and the rear end of the sheet in the conveyance direction is retracted into the loop forming space through switchback at a time when the sheet is conveyed by a specific distance.

7. The sheet folding processing apparatus according to claim 6, wherein, in a case that the folding processing is performed on the sheet by the folding unit and the rear end of the sheet in the conveyance direction is retracted into the loop forming space through the switchback at a time when the sheet is conveyed by the specific distance, the specific distance is set so that a front end of the sheet in the conveyance direction does not cause an influence on operation of a downstream apparatus.

8. An image forming system, comprising:

an image forming apparatus which forms an image on a sheet; and the sheet folding processing apparatus according to claim 1.

* * * * *